US008876209B2

(12) United States Patent
Peterson et al.

(10) Patent No.: US 8,876,209 B2
(45) Date of Patent: Nov. 4, 2014

(54) CONFORMING BACK FOR A SEATING UNIT

(75) Inventors: Gordon J. Peterson, Rockford, MI (US); Christopher J. Norman, Byron Center, MI (US); Russell Holdredge, Alto, MI (US); Bruce Smith, Grand Rapids, MI (US); Luke Pearson, London (GB); Thomas Overthun, San Francisco, CA (US); Kara Johnson, San Francisco, CA (US)

(73) Assignee: Steelcase Inc., Grand Rapids, MI (US)

( * ) Notice: Subject to any disclaimer, the term of this patent is extended or adjusted under 35 U.S.C. 154(b) by 237 days.

(21) Appl. No.: 12/454,995

(22) Filed: May 26, 2009

(65) Prior Publication Data

US 2010/0072799 A1 Mar. 25, 2010

Related U.S. Application Data

(60) Provisional application No. 61/056,051, filed on May 26, 2008.

(51) Int. Cl.

| | |
|---|---|
| ***A47C 7/46*** | (2006.01) |
| ***A47C 7/44*** | (2006.01) |
| ***A47C 7/40*** | (2006.01) |
| ***A47C 3/12*** | (2006.01) |

(52) U.S. Cl.

CPC . *A47C 7/44* (2013.01); *A47C 7/405* (2013.01); *A47C 3/12* (2013.01)

USPC ..... 297/284.1; 297/452.15; 297/452.29; 297/452.63

(58) Field of Classification Search

CPC ..... A47C 3/12; A47C 5/12; A47C 7/16; A47C 7/40

USPC ..... 297/284.1, 452.15, 452.29, 452.63

See application file for complete search history.

(56) References Cited

U.S. PATENT DOCUMENTS

| | | | |
|---|---|---|---|
| 293,833 | A | 2/1884 | Winchester |
| 398,179 | A | 2/1889 | Parry |
| 538,708 | A | 5/1895 | Smith |
| 2,016,953 | A | 10/1935 | Arnold |

(Continued)

FOREIGN PATENT DOCUMENTS

| | | | |
|---|---|---|---|
| DE | 19526437 | A1 | 1/1997 |
| EP | 2130456 | A1 | 12/2009 |

(Continued)

OTHER PUBLICATIONS

Extended European Search Report and Preliminary Opinion, European Patent Application No. 09762841.6, Jul. 22, 2011.

(Continued)

*Primary Examiner* — Laurie Cranmer

(74) *Attorney, Agent, or Firm* — McDermott Will & Emery LLP

(57) ABSTRACT

According to the present invention a back for a seating unit is provided. The back comprises a plurality of flexible finger elements. Each of the plurality of flexible finger elements has a distal end. The back further comprises a retainer connecting at least two of the flexible finger elements proximate their distal ends. When a load is applied to a flexible finger element, the retainer distributes at least a portion of the load to at least one adjacent flexible finger element.

2 Claims, 12 Drawing Sheets

(56) References Cited

U.S. PATENT DOCUMENTS 2,182,485 A 12/1939 Murdock
2,365,334 A 12/1944 De Vries
2,530,924 A * 11/1950 Turner ..... 297/452.15
D164,204 S 8/1951 Smith
2,648,372 A 8/1953 Smith
2,649,147 A 8/1953 Sanford
2,798,538 A 7/1957 Dreifke
2,843,195 A * 7/1958 Barvaeus ..... 297/284.4
2,893,476 A 7/1959 Liljengren
2,894,565 A 7/1959 Conner
D194,740 S 3/1963 Parker
3,106,423 A 10/1963 Schwarz
D197,512 S 2/1964 Poisson
3,135,552 A 6/1964 Lockshin
3,135,553 A 6/1964 Lockshin
3,203,734 A * 8/1965 Seymer ..... 297/452.63
D212,470 S 10/1968 Rutter
3,565,482 A 2/1971 Blodee
3,669,499 A 6/1972 Semplonius et al.
3,752,533 A 8/1973 Gilbert
3,813,148 A 5/1974 Kraus
3,877,750 A 4/1975 Scholpp
3,948,558 A 4/1976 Obermeier et al.
3,982,785 A 9/1976 Ambasz
3,989,297 A 11/1976 Kerstholt
4,007,962 A 2/1977 Müller-Deisig
4,054,318 A 10/1977 Costin
4,062,590 A 12/1977 Polsky et al.
4,084,850 A 4/1978 Ambasz
4,157,203 A 6/1979 Ambasz
4,314,728 A 2/1982 Faiks
4,316,632 A 2/1982 Bräuning
4,333,683 A 6/1982 Ambasz
4,380,352 A 4/1983 Diffrient
4,498,702 A 2/1985 Raftery
4,502,728 A 3/1985 Sheldon et al.
4,521,053 A 6/1985 de Boer
4,544,204 A 10/1985 Schmale
4,585,272 A 4/1986 Ballarini
4,621,866 A 11/1986 Zani
4,641,884 A 2/1987 Miyashita et al.
4,660,887 A 4/1987 Fleming et al.
4,685,730 A 8/1987 Linguanotto
4,703,974 A 11/1987 Bräuning
4,744,603 A 5/1988 Knoblock
4,776,633 A 10/1988 Knoblock et al.
4,810,033 A * 3/1989 Kemmann ..... 297/284.4
4,834,453 A 5/1989 Makiol
4,848,837 A 7/1989 Völkle
4,861,108 A 8/1989 Acton et al.
4,896,918 A 1/1990 Hoshihara
4,928,334 A 5/1990 Kita
4,966,413 A 10/1990 Palarski
4,968,093 A 11/1990 Dal Monte
4,981,326 A 1/1991 Heidmann
5,009,466 A 4/1991 Perry
5,015,034 A 5/1991 Kindig et al.
5,015,038 A 5/1991 Mrotz, III
D319,354 S 8/1991 Wolcott
5,039,163 A 8/1991 Tolleson
5,040,847 A * 8/1991 Nguyen ..... 297/447.1
5,044,693 A 9/1991 Yokota
5,050,930 A 9/1991 Schuster et al.
5,050,931 A 9/1991 Knoblock
5,062,676 A 11/1991 Mars
5,087,098 A 2/1992 Ishizuka
5,100,201 A 3/1992 Becker, III et al.
5,102,196 A 4/1992 Kaneda et al.
5,112,108 A 5/1992 Zapf
5,120,109 A 6/1992 Rangoni
5,121,963 A 6/1992 Kwasnik et al.
D330,292 S 10/1992 Nguyen
D332,530 S 1/1993 Nguyen
5,217,278 A 6/1993 Harrison et al.
5,240,308 A 8/1993 Goldstein et al.
5,249,839 A 10/1993 Faiks et al.
D341,265 S 11/1993 Gehry
5,277,475 A 1/1994 Brandes
D344,191 S 2/1994 Gehry
D345,656 S 4/1994 Theobald
5,299,851 A 4/1994 Lin
5,302,002 A 4/1994 Nagasaka
5,320,410 A 6/1994 Faiks et al.
5,333,934 A 8/1994 Knoblock
5,338,091 A 8/1994 Miller
5,338,094 A 8/1994 Perry
5,352,022 A 10/1994 Knoblock
5,354,120 A 10/1994 Völkle
5,366,273 A * 11/1994 Bresch ..... 297/316
5,380,063 A 1/1995 Dauphin
5,385,388 A 1/1995 Faiks et al.
5,405,188 A 4/1995 Hanson
D360,538 S 7/1995 Skalka
5,447,356 A 9/1995 Snijders
5,460,427 A 10/1995 Serber
D363,844 S 11/1995 Maple et al.
5,474,360 A 12/1995 Chang
5,487,591 A 1/1996 Knoblock
5,518,294 A 5/1996 Ligon, Sr. et al.
5,540,481 A 7/1996 Roossien et al.
5,573,302 A 11/1996 Harrison et al.
5,575,534 A 11/1996 Yu
5,577,807 A 11/1996 Hodge et al.
5,577,811 A 11/1996 Ogg
5,582,459 A 12/1996 Hama et al.
5,590,932 A 1/1997 Olivieri
5,597,203 A 1/1997 Hubbard
5,611,598 A 3/1997 Knoblock
5,630,647 A 5/1997 Heidmann et al.
5,662,383 A 9/1997 Hand
5,664,835 A * 9/1997 Desanta ..... 297/302.1
D384,511 S 10/1997 Gresens
5,683,142 A 11/1997 Gunderson et al.
5,716,099 A 2/1998 McDiarmid
5,762,403 A 6/1998 Robinson
5,769,500 A 6/1998 Holbrook
5,791,736 A 8/1998 Herbert
5,810,438 A * 9/1998 Newhouse ..... 297/286
5,863,094 A 1/1999 Endo
5,871,258 A 2/1999 Battey et al.
5,904,397 A 5/1999 Fismen
5,938,284 A 8/1999 Coffield
D413,452 S 9/1999 Rhienen
D415,626 S 10/1999 Van Rhienen
D420,522 S 2/2000 Rhienen
D420,824 S 2/2000 Lin
6,019,428 A 2/2000 Coffield
6,027,171 A 2/2000 Partington et al.
6,059,368 A 5/2000 Stumpf et al.
D430,975 S 9/2000 Grosfillex
D431,922 S 10/2000 Grosfillex
6,139,110 A 10/2000 Jeng
6,164,726 A 12/2000 Reeves et al.
D437,134 S 2/2001 Anderson et al.
6,186,594 B1 * 2/2001 Valiquette et al. ..... 297/284.4
6,231,125 B1 5/2001 Maeda et al.
D443,430 S 6/2001 Anderson et al.
6,378,942 B1 4/2002 Chu
6,378,944 B1 4/2002 Weisser
6,386,634 B1 5/2002 Stumpf et al.
6,386,638 B1 5/2002 Strauch
6,394,548 B1 5/2002 Battey et al.
6,409,268 B1 * 6/2002 Cvek ..... 297/452.29
6,419,318 B1 7/2002 Albright
6,422,650 B1 7/2002 Chien-Shen
6,439,665 B1 8/2002 Cvek
6,499,802 B2 12/2002 Drira
6,511,562 B1 1/2003 Coffield
D469,619 S 2/2003 Stewart
D470,669 S 2/2003 Stewart
6,523,898 B1 2/2003 Ball et al.
6,540,950 B1 4/2003 Coffield
6,550,866 B1 4/2003 Su
6,669,292 B2 12/2003 Koepke et al.

(56) References Cited

U.S. PATENT DOCUMENTS

| | | | | |
|---|---|---|---|---|
| 6,669,301 | B1 * | 12/2003 | Funk et al. | 297/452.63 |
| 6,688,687 | B2 | 2/2004 | Chu | |
| 6,688,690 | B2 | 2/2004 | Watson et al. | |
| 6,698,833 | B2 | 3/2004 | Ball et al. | |
| 6,712,427 | B1 | 3/2004 | Bourdkane et al. | |
| 6,715,839 | B2 | 4/2004 | Legal | |
| 6,726,286 | B2 | 4/2004 | Stumpf et al. | |
| 6,755,467 | B1 * | 6/2004 | Chu | 297/284.1 |
| 6,758,528 | B2 | 7/2004 | Kawashima | |
| 6,811,218 | B2 | 11/2004 | Deimen et al. | |
| 6,842,959 | B2 | 1/2005 | Coffield et al. | |
| 6,890,030 | B2 | 5/2005 | Wilkerson et al. | |
| 6,899,398 | B2 | 5/2005 | Coffield | |
| 6,908,159 | B2 | 6/2005 | Prince et al. | |
| 6,913,315 | B2 | 7/2005 | Ball et al. | |
| 6,918,633 | B2 | 7/2005 | Forkel et al. | |
| 6,942,300 | B2 | 9/2005 | Numa et al. | |
| 6,955,402 | B2 | 10/2005 | VanDeRiet et al. | |
| 6,966,606 | B2 | 11/2005 | Coffield | |
| 6,969,115 | B2 | 11/2005 | Bourdkane et al. | |
| 6,971,717 | B1 | 12/2005 | Rhodes | |
| 6,983,997 | B2 | 1/2006 | Wilkerson et al. | |
| 7,032,971 | B2 | 4/2006 | Williams | |
| 7,096,549 | B2 | 8/2006 | Coffield | |
| 7,097,247 | B2 | 8/2006 | Battey et al. | |
| 7,128,373 | B2 | 10/2006 | Kurtycz et al. | |
| 7,131,694 | B1 | 11/2006 | Buffa | |
| 7,159,293 | B2 | 1/2007 | Coffield et al. | |
| 7,216,933 | B2 | 5/2007 | Schmidt et al. | |
| 7,270,378 | B2 | 9/2007 | Wilkerson et al. | |
| D553,376 | S | 10/2007 | Nakamura et al. | |
| 7,367,629 | B2 | 5/2008 | Kepler et al. | |
| 7,604,298 | B2 * | 10/2009 | Peterson et al. | 297/440.2 |
| 7,841,664 | B2 * | 11/2010 | Holdredge et al. | 297/300.2 |
| 7,841,666 | B2 * | 11/2010 | Schmitz et al. | 297/440.2 |
| 2002/0195863 | A1 | 12/2002 | Su | |
| 2004/0245840 | A1 | 12/2004 | Tubergen et al. | |
| 2004/0262975 | A1 | 12/2004 | Su | |
| 2005/0093354 | A1 | 5/2005 | Ball et al. | |
| 2005/0200189 | A1 | 9/2005 | Schultz et al. | |
| 2006/0006715 | A1 | 1/2006 | Chadwick et al. | |
| 2007/0035169 | A1 | 2/2007 | Sawyer | |
| 2007/0057548 | A1 | 3/2007 | Buffa | |
| 2007/0057549 | A1 | 3/2007 | Ball et al. | |
| 2007/0228799 | A1 | 10/2007 | Kinoshita et al. | |
| 2007/0257531 | A1 | 11/2007 | Mashimo | |
| 2007/0267912 | A1 * | 11/2007 | Britton et al. | 297/452.49 |
| 2008/0122284 | A1 | 5/2008 | Yang | |
| 2008/0122285 | A1 | 5/2008 | Lin | |

FOREIGN PATENT DOCUMENTS

| | | | |
|---|---|---|---|
| JP | 2008-080090 | | 4/2008 |
| JP | 2008080092 | A | 4/2008 |
| WO | 9406339 | A1 | 3/1994 |

OTHER PUBLICATIONS

Written Opinion and International Search Report Issued in connection with PCT Application No. PCT/US2009/003235 dated Jan. 19, 2010.

* cited by examiner

CONFORMING BACK FOR A SEATING UNIT

CROSS REFERENCE TO RELATED APPLICATIONS

The present invention claims priority to U.S. Provisional Patent Application No. 61/056,051, filed May 26, 2008.

TECHNICAL FIELD

The present invention relates generally to a back for a seating unit, and more particularly, to back that conforms to the user.

BACKGROUND OF THE INVENTION

It is generally known to provide support for individuals sitting in a chair. It has been determined that certain shapes for chair backs provide increased support for individuals, thereby minimizing stress on the bodies of individuals, such as back stress, and providing a more comfortable sitting experience.

Comfort features that require little or no adjustment, particularly those directed to the back region, are in increasing demand in seating design. Prior designs have attempted to incorporate adjustment features in an effort to minimize stress on a user. For example, adjustments such as tilting backrests and slidable chair seats have been employed. Such mechanisms often require complex controls, linkages and other parts. Many chairs, such as collaborative seating, conference room seating, seating in team spaces and lobby seating, are utilized for relatively short periods of time or used by multiple people. Users typically will not take the time to make multiple adjustments on chairs used for a short period of time. When a user leaves the chair, it will generally be occupied by a new user. People come in various heights and sizes and any user adjustments to optimize comfort made by a first user are unlikely to be optimized for the next user. As a result task chairs with multiple adjustments tend not to be used in collaborative and short-term sitting applications. An alternative is a chair that is often used in short-term and collaborative environments with few or no adjustments. These chairs are sub-optimized for most users. It is desirable to provide a chair that self-adjusts to accommodate a variety of people or with minimal adjustment. Moreover, regular changes in body posture resulting from sitting for protracted periods pose unique problems in designing an ergonomic system not fully addressed by these designs. As such, many past chair solutions provide only monolithic solutions to wide ranging ergonomic needs. Thus, past designs have failed to provide adequate comfort to varying individuals that sit with disparate postures. It is, therefore, desirable to provide a chair back that conforms to the body, and in particular, on the lumbar and thoracic regions of the back of a variety of users sitting in disparate positions.

In lobbies and other public spaces it is desirable to keep a particular look or orientation to the furniture. Prior designs provide seating units with fixed orientation which a user is unlikely to move and which does not facilitate alternative postures or full utilization of the furniture. For example, two chairs set next to each other in a lobby orient their users parallel to each other. The users must rotate their bodies in order to look each other in the eye as the converse. It is desirable to have seats and/or backs which swivel to allow the user to orient himself relative to his or her task or other people. It is also desirable to have a chair which allows for alternative postures.

The present invention is provided to solve the problems discussed above and other problems, and to provide advantages and aspects not previously provided. A full discussion of the features and advantages of the present invention is deferred to the following detailed description, which proceeds with reference to the accompanying drawings.

SUMMARY OF THE INVENTION

According to the present invention a back for a seating unit is provided. The back comprises a plurality of flexible finger elements. Each of the plurality of flexible finger elements has a distal end. The back further comprises a retainer connecting at least two of the flexible finger elements proximate their distal ends. When a load is applied to a finger element, the retainer distributes at least a portion of the load to at least one adjacent flexible finger element.

According to another aspect of the invention, a comfort surface for a seating unit is provided. The comfort surface includes a plurality of flexible finger elements having distal ends. The comfort surface further comprises a retainer. The retainer connects at least two of the flexible finger elements proximate their distal ends. In use, the movement of the plurality of flexible finger elements and the retainer is cooperative.

According to another aspect of the invention, a seating unit is provided. The seating unit comprises a seat and a back which is adapted to be coupled to the seat. The back comprises a plurality of flexible finger elements and a retainer. The flexible finger elements have distal ends, and the retainer connects at least two of the flexible finger elements proximate their distal ends. The plurality of flexible finger elements and the retainer adapt to the shape of a user.

Other features and advantages of the invention will be apparent to those of skill in the art from the following specification and claims, taken in conjunction with the appended drawings.

BRIEF DESCRIPTION OF THE DRAWINGS

To understand the present invention, it will now be described by way of example, with reference to the accompanying drawings in which.

Figure 1:
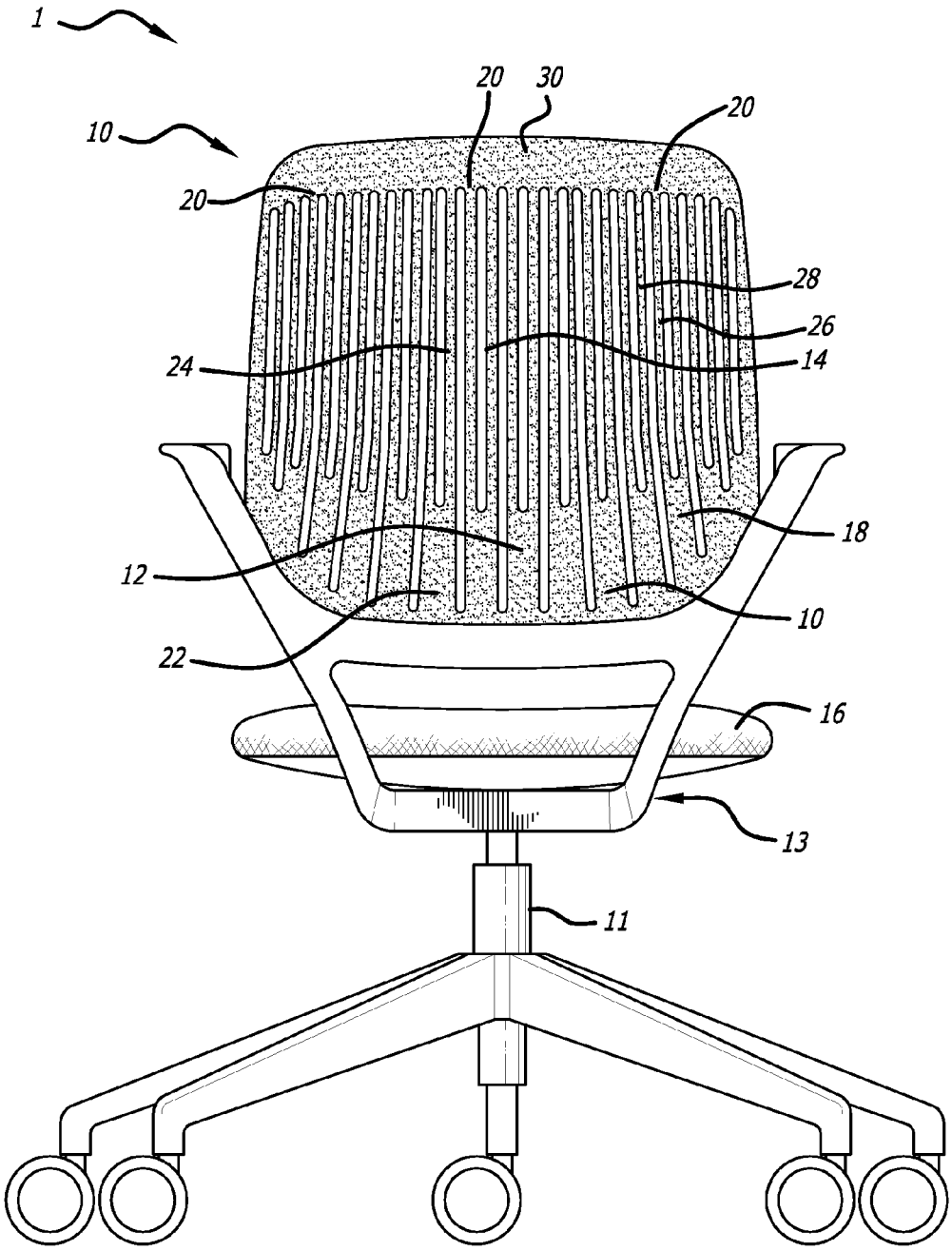
FIG. 1 is a back view of a back for a seating unit.
Figure 1A:
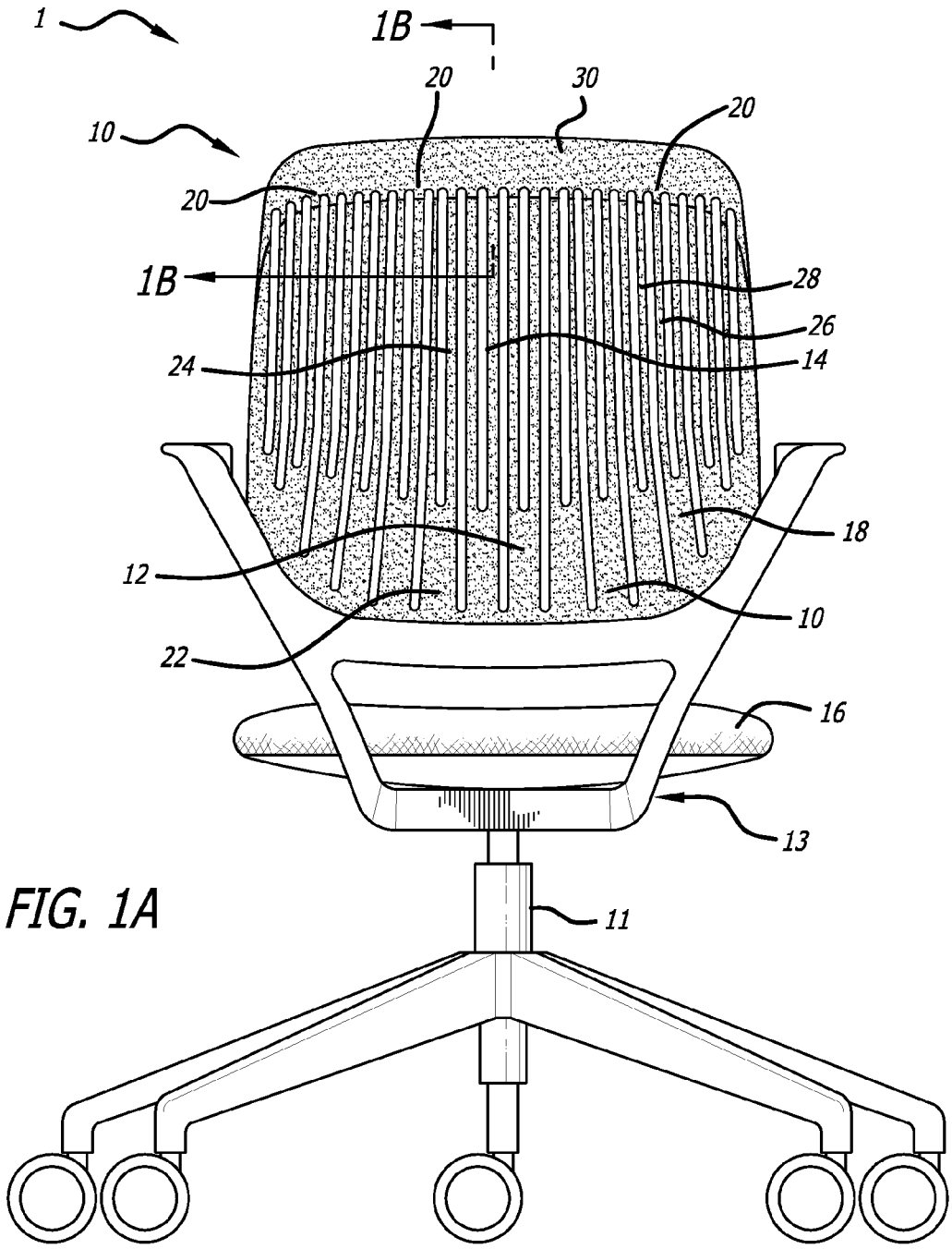
FIG. 1A is a back view of another embodiment of a back for seating unit.
Figure 1B:
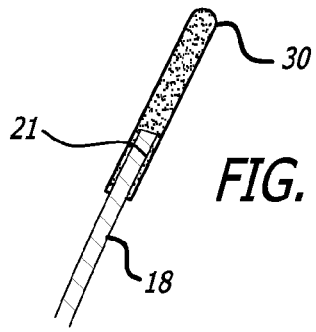
FIG. 1B is a cross-sectional view of the back of FIG. 1A taken along the line 1B-1B.

The components in the drawings are not necessarily to scale, emphasis instead being placed upon clearly illustrating the principles of the present invention.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

As shown in FIGS. 1-10, a seating unit 1 incorporating a back 10 of the present invention typically includes a base 11, and a seat 16. The back 10 is typically coupled to the seat 16 or base such that the back 10 is disposed in a direction that is generally transverse to the generally horizontally disposed seat 16. The seat 16 and back 10 can be operably supported on a base 11 by an underseat control system 13. The seat and/or back may be supported on a frame or other structure. The back 10 may be connected to the seat 16, the base 11, the frame, other support structure or to another element.

The horizontally disposed seat 16 is merely meant to provide a relative position plane about which components of the seating unit 1 may be directionally arranged. And although it will be understood that the seat 16 is generally disposed horizontally, it will also be understood that the seat 16 may be disposed slightly off of the horizontal (e.g., an incline, etc.), and that the seat 16 may be contoured (e.g., concavely, including bolsters, etc.). Accordingly, it is also understood that because the back 10 is disposed in a direction that is generally transverse to the seat 16, the back 10 may be positioned at any angle that causes the back 10 to extend generally upward from the seat 16.

As shown in FIGS. 1-4, the back 10 generally includes a plurality of flexible finger elements 18, each having a distal end. In one embodiment of the invention, shown in FIGS. 1-2, the plurality of flexible finger elements 18 are disposed in a direction generally vertical relative to the seat 16. Each of the flexible finger elements 18 may flex a distance independent of the other flexible finger elements 18. It is preferable that there is some interdependency in the flexibility of some of the adjacent flexible finger elements 18 provided by a retainer 30 coupled to the flexible finger elements 18. Depending on the retainer 30, each of the flexible finger elements 18 may be capable of independently flexing a given distance as a result of an application of a force without necessitating that each of the other flexible finger elements 18 flex the same distance, or even at all.

The retainer 30 connects at least two of the flexible finger elements 18 proximate their distal ends. It is preferable that when a load is applied to at least one of the flexible finger elements 18, the load is transferred to at least one adjacent flexible finger element 18 via the retainer 30. When a load is applied to at least one of the flexible finger elements 18, the retainer 30 controls the distance the flexible finger element 18 flexes and how much each adjacent flexible finger element 18 flexes, as will be further described below. It is preferable that each of the flexible finger elements 18 are connected to at least one other flexible finger element 18 by the retainer 30. It is also preferable that flexible finger elements 18 connect to adjacent flexible finger elements 18 via the retainer 30. The flexible finger elements 18 and retainer 30 work as a unit to distribute an applied load.

Figure 2:
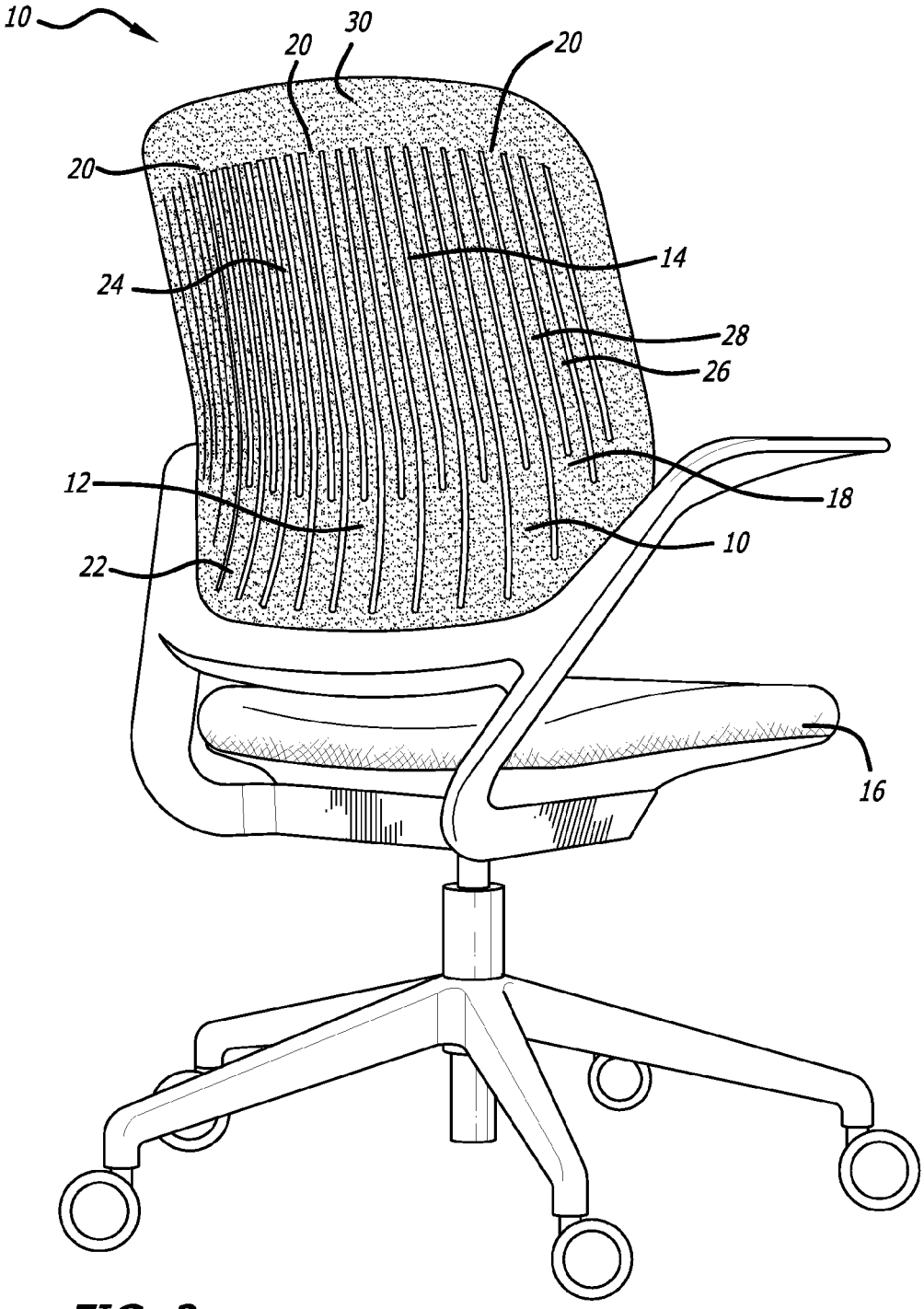
FIG. 2 is a perspective view of the back of FIG. 1.
Figures 3, 3A:
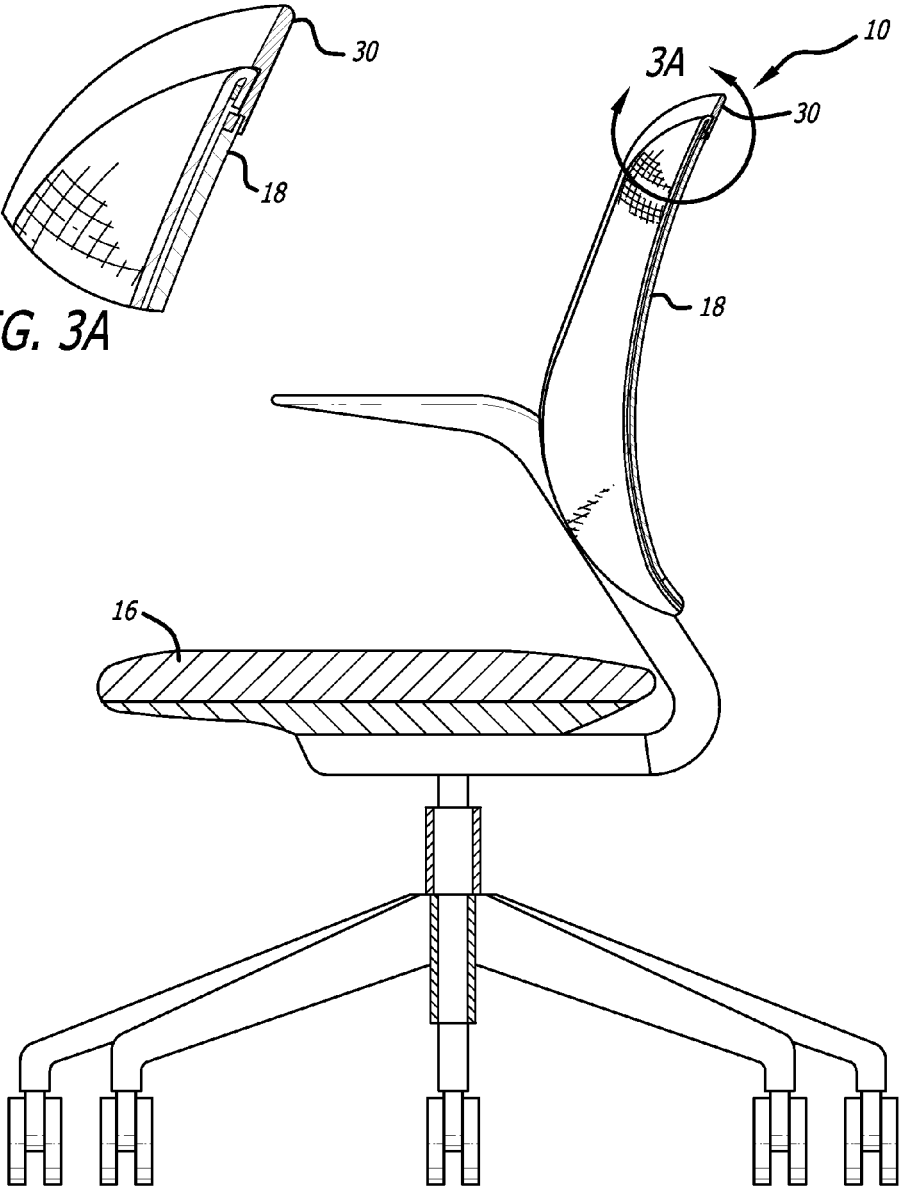
FIG. 3 is a side view of the back of FIG. 1.
FIG. 3A is a close-up of the retainer of FIG. 3.
Figure 3B:
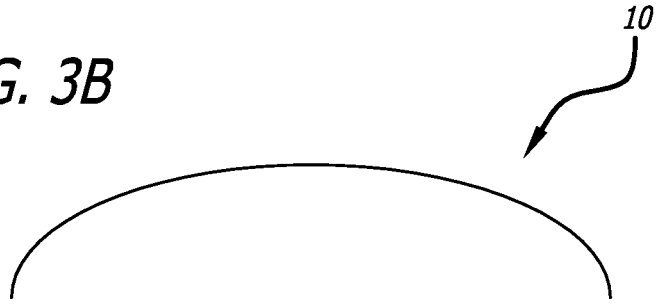
FIG. 3B is a top view of the chair back of FIG. 3.
Figure 4A:
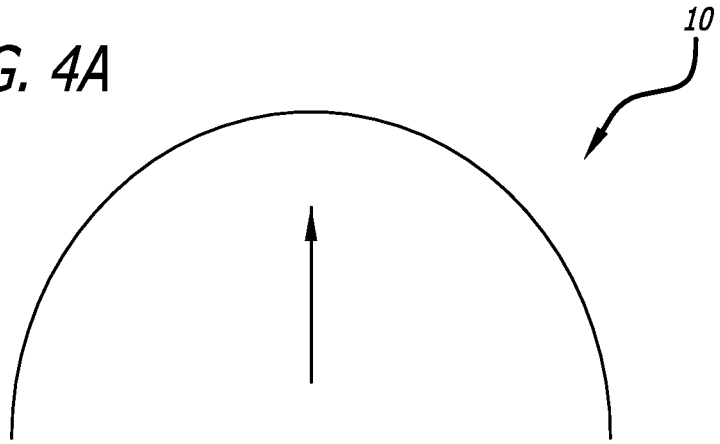
FIG. 4A is a top view of the back of FIG. 4.
Figure 4:
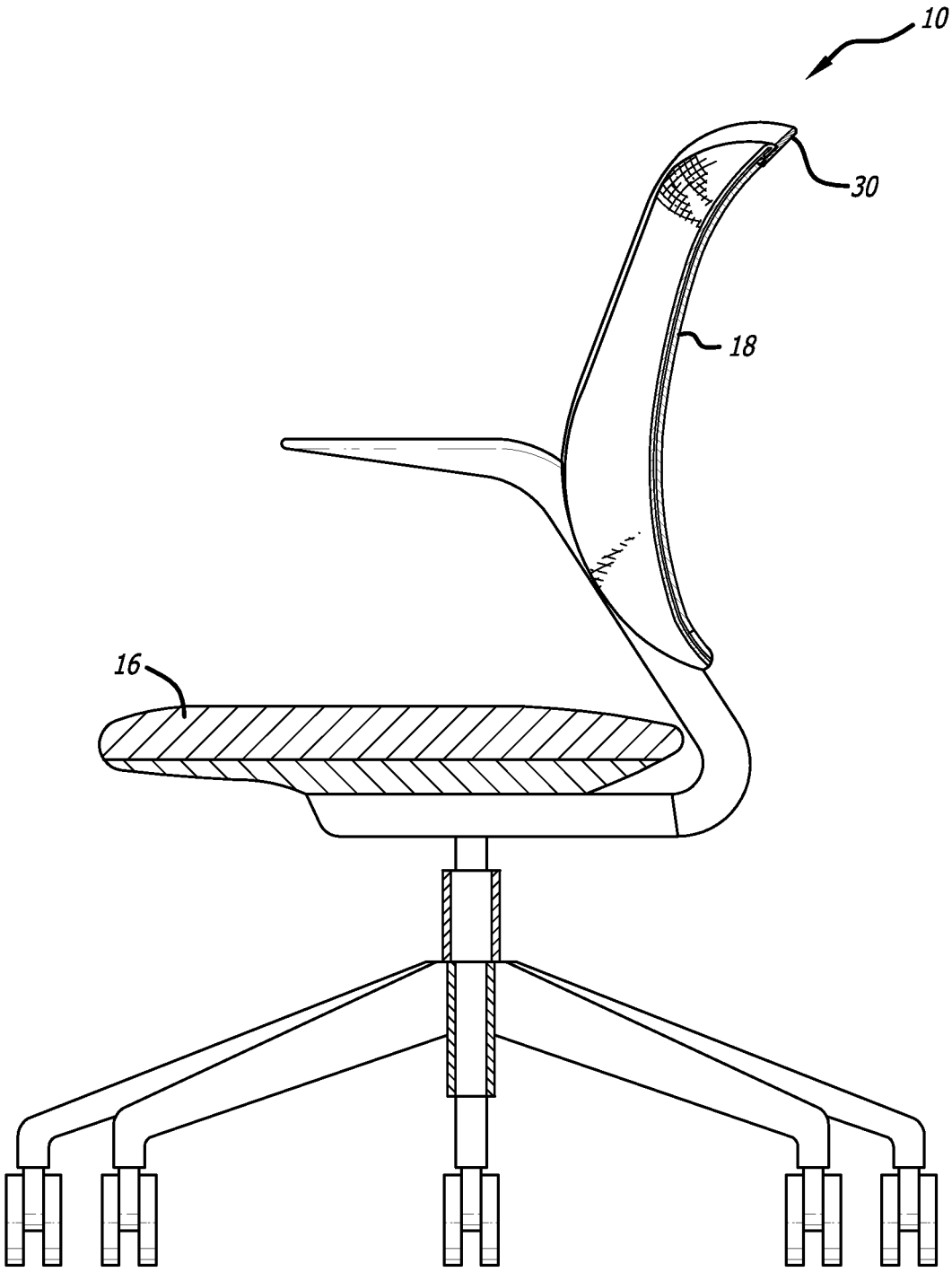
FIG. 4 shows the back of FIG. 3 when a load is applied.

In one embodiment of the invention, the retainer 30 defines at least part of an outer edge of the back 10 as shown by FIGS. 1-2. For example, the retainer 30 can define a portion of an upper edge of the back 10. The retainer 30 can also extend downward from the upper edge to define a portion or the entirety of the side edges of the back 10. The retainer 30 may be overmolded over the flexible finger elements 18, such as with a two-shot molding process. Alternatively, the retainer 30 may include a plurality of apertures or channels 21. The apertures 21 correspond to and retain the distal ends of the flexible finger elements 18. Alternatively, the flexible finger elements 18 may be mechanically attached to the retainer 30 such as with snaps, hooks, threaded through a ring, sewn, or otherwise attached. The retainer 30 could be a flexible strap such as an elastic strap or bungee coupled to the flexible finger elements 18. The retainer 30 forms an upper periphery of the back, it may extend above the distal ends of the flexible finger elements 18 and be adapted to bend at a position above the distal ends of the flexible finger elements 18 to form a ledge. This occurs when a user puts a load on the upper edge, such as by resting his or her arm over the upper edge.

As shown in FIGS. 1-4, the retainer 30 assists in distributing at least a portion of a load applied to the flexible finger elements 18. Accordingly, when a load is applied to the back 10, such as when the back of a seated user contacts the flexible finger elements 18, as a user moves against the back 10, the plurality of flexible finger elements 18 will articulate in a responsive serpentine-like movement to conform to the general form of the user, as well as to distribute the load among the flexible finger elements 18. When a user is seated in the seating unit 1 the flexible finger elements 18 conform to the user's body. As a seated user contacts the back 10, the force applies to each flexible finger element 18 the user contacts causes that flexible finger element 18 to flex. The flexible finger elements 18 cause the retainer 30 to move/flex adjacent flexible finger elements 18. The adjacent flexible finger elements 18 flex and move and the back 10 conforms to the user, wrapping around the user as each adjacent flexible finger element 18 moves to a lesser degree than the flexible finger elements 18 where force is directly applied by the user. The flexible finger elements 18 connected by the retainer 30 work in conjunction to conform to the contours of differing users. As a load is applied to at least one flexible finger element 18, it is transferred to adjacent flexible finger elements 18. The arrangement of the flexible finger elements 18 along the back 10 allows them to collectively provide support to a user. It also allows the back 10 to adjust and conform to a user's shifting positions.

According to the present invention, the retainer 30 has a third flexibility. The third flexibility may be greater than the flexibility provided by the flexible finger elements 18. The third flexibility primarily is attributable to the modulus of elasticity of the material used to form the retainer 30. According to one embodiment of the invention, the retainer 30 is made from thermoplastic olefin (TPO). However, it will be understood by those of skill in the art that the retainer 30 may be alternatively made from thermoplastic elastomers (TPE), rubber or any other material suitable for providing some flexibility in response to the application of a load. The material used for the retainer 30 may constrain and control the motion of the flexible finger elements 18 relative to adjacent flexible finger elements 18. Once it reaches the limit of elasticity, the retainer 30 may act as a limiter to constrain further flexing or movement of the flexible finger elements 18. Alternatively the orientation of the flex of the retainer 30 may be different than that of the flexible finger elements 18. That orientation can be adapted to control the movement of the flexible finger elements 18.

The retainer 30 could also be a relatively inflexible element which allows the flexible finger elements 18 to move independently, and act as a limiter to the flexing of the flexible finger elements 18 at a preselected distance. For example, the retainer 30 could be a cable or chain. As a load is applied to the flexible finger elements 18, slack in the retainer 30 would reduce until the retainer 30 is fully extended. The flexible finger elements 18 would thus be prevented from moving further and load would be distributed to adjacent flexible finger elements 18.

The back 10 may include a first flexible zone 22 of the back 10 and a second flexible zone 24 of the back 10. The first flexible zone 22 of the back 10 has a first flexibility, and the second flexible zone 24 of the back 10 has a second flexibility that is greater than the first flexibility. The first flexible zone 22 as shown in FIGS. 1-2 generally defines at least a portion of a lumbar region 12 of the back 10. The lumbar region 12 of the back 10 is the region near the bottom of the back 10. If a user were to be using the back 10, the lumbar region 12 would be proximate the user's lower spine. The second flexible 24 zone generally defines a portion of the back 10 extending from the lumbar region 12 through at least a portion of a thoracic region 14 of the back 10. The thoracic region 14 of the back 10 is the region disposed proximate to and above the lumbar region 12.

The degree of flexibility of the flexible finger elements 18, as well as the flexibility of the first and second flexible zones 22, 24, is dependent on many factors, including the configuration of the flexible finger elements 18, the modulus of elasticity of the material used to make the flexible finger elements 18, and the spacing between the flexible finger elements 18. According to one embodiment of the invention, the flexible finger elements 18 are made from polypropylene. However, it will be understood by those of skill in the art that the flexible finger elements 18 may be alternatively made from glass filled nylon, steel, fiberglass, or any other material suitable for providing some flexibility in response to the application of a load.

In one embodiment of the invention, each of the flexible finger elements 18 is spaced approximately ⅜ inch or less from one another. However, the scope of the present invention should not be limited by this exact spacing. One of skill in the art would understand that the spacing will be dictated by the material choice, length of the flexible finger elements 18, comfort, strength, manufacturing and other factors. Accordingly, the flexible finger elements 18 can be spaced at any distance suitable for providing some flexibility as a result of application of a load would.

The configuration of the flexible finger elements 18 may also cause a variation in the flexibility of the flexible finger elements 18 and between the first and second flexible zones 22, 24. As shown in FIGS. 1-2, the flexible finger elements 18 have greater width as they extend toward the lumbar region 12 from the thoracic region 14 of the back 10; the flexible finger elements 18 may be narrower in the thoracic region 14 as shown. The flexible finger elements 18 may taper toward their distal ends, or they may have a consistent profile. The difference in width of the flexible finger elements 18 can allow the second flexible zone 24 to be more flexible than the first flexible zone 22 even though the flexible finger elements 18 may be comprised of the same material.

According to one embodiment of the present invention, a distal end 20 of the flexible finger elements 18 is defined by a first flexible prong 26 and a second flexible prong 28. In this embodiment, the distal ends of the prongs 26, 28 are connected to the retainer 30. Thus, the first and second flexible prongs 26, 28 define the second zone of flexibility 24. This configuration can provide even greater variation of in flexibility between flexible finger elements 18 and flexible zones 22, 24. The prongs 26, 28 allow for differing back contours, as the seated user moves or changes postures in the chair, which result from the differing back flex. Accordingly, in this configuration, the first flexible prong 26 can also be flexible independent of the second flexible prong 28. In the embodiment shown, the flexible prongs 26, 28 are integrally formed with the flexible finger elements 18. However, it is contemplated that the flexible prongs 26, 28 may also be separate components that are attachably coupled to the distal ends of the flexible finger elements 18 by known connectors. It is also contemplated by the present invention that some of the plurality of flexible finger elements 18 include flexible prongs 26, 28, while other of the flexible finger elements 18 do not include flexible prongs 26, 28.

The degree of flexibility of each of the flexible prongs 26, 28 is dependent on many factors, including the configuration of the flexible prongs 26, 28, the modulus of elasticity of the material used to make the flexible prongs 26, 28, and the spacing between the flexible prongs 26, 28. According to one embodiment of the invention, the flexible prongs 26, 28 are made from polypropylene. However, it will be understood by those of skill in the art that the flexible prongs 26, 28 may be alternatively made from glass filled nylon, steel or any other material suitable for providing some flexibility in response to the application of a load.

Figure 5:
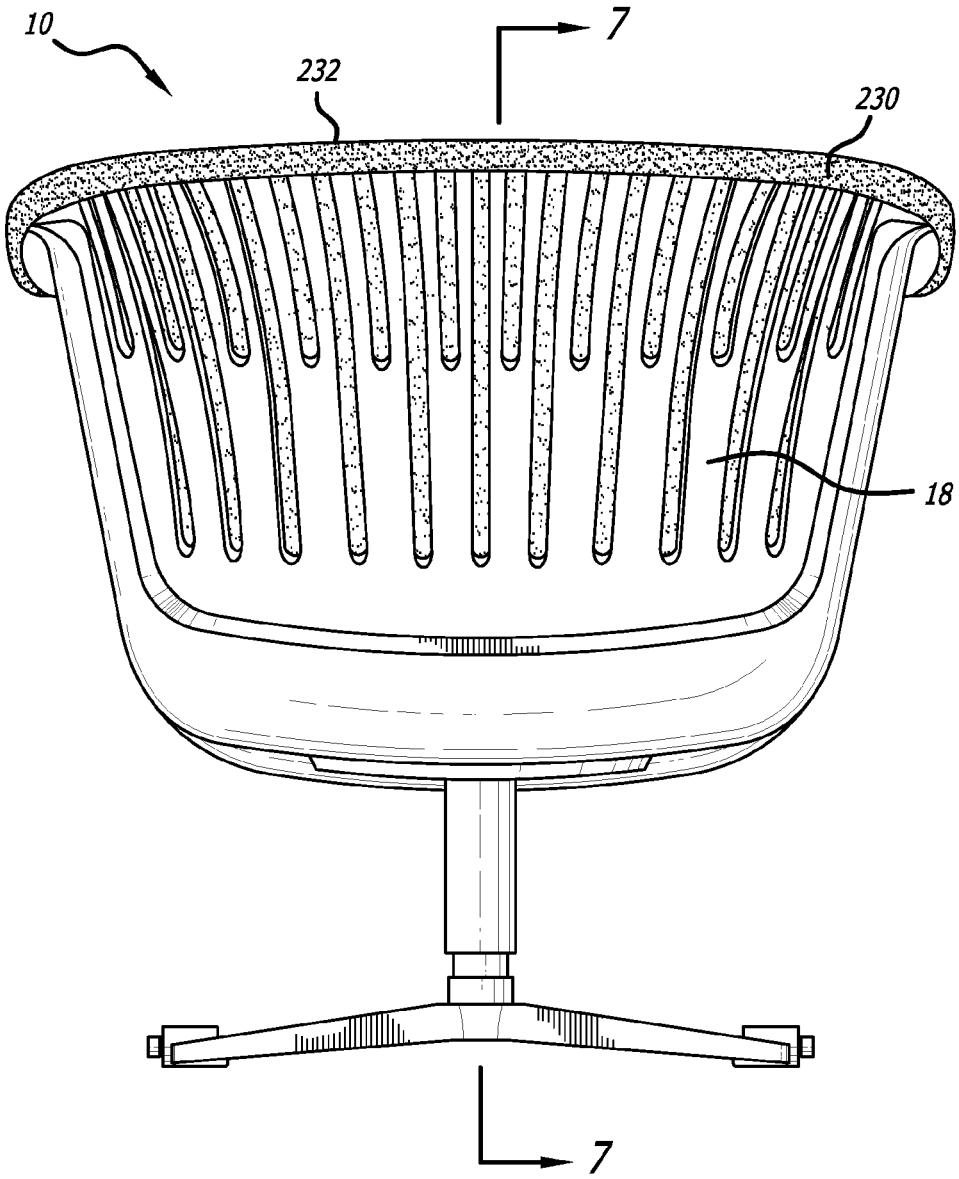
FIG. 5 is a back view of another back for a seating unit.
Figure 6:
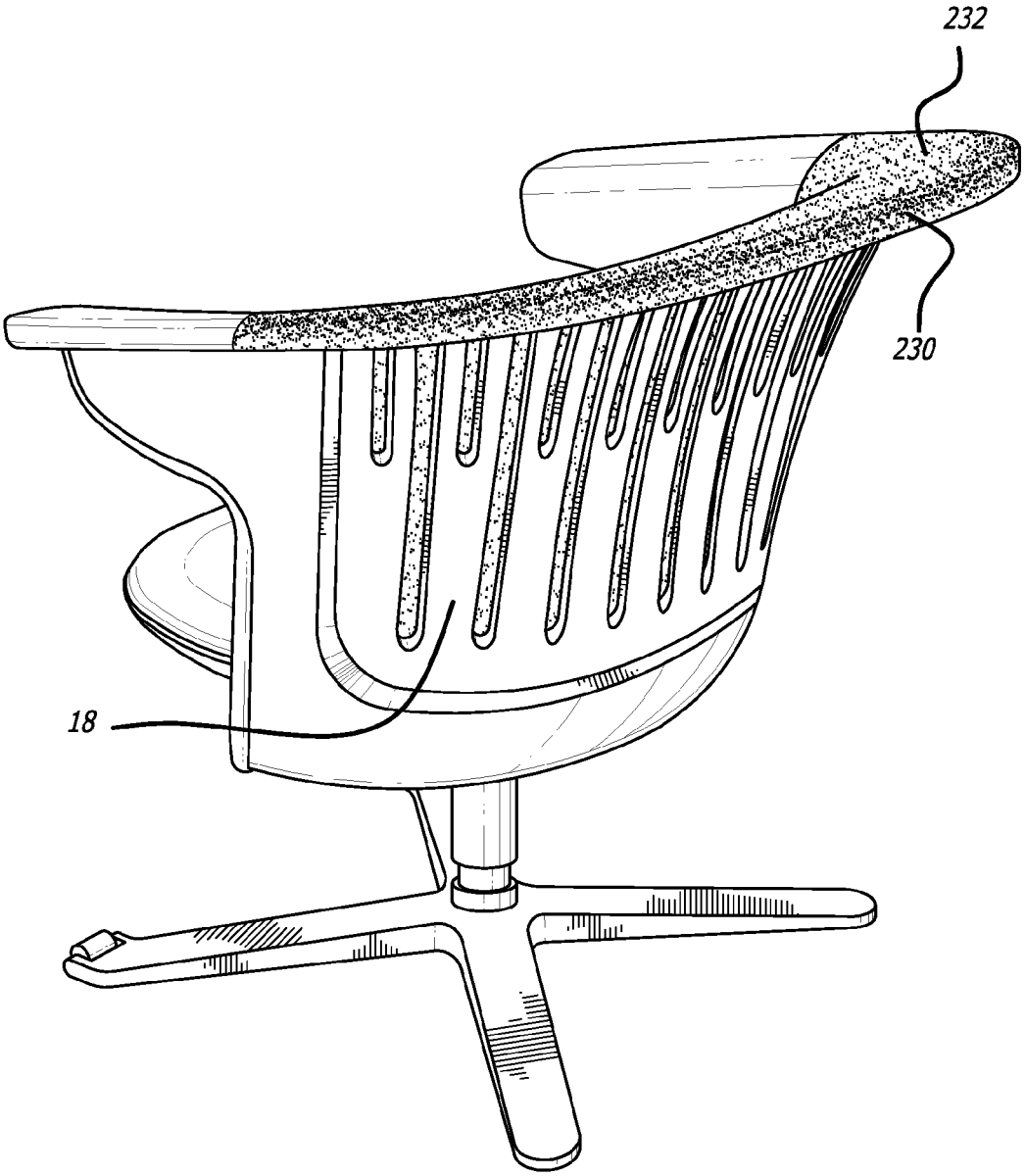
FIG. 6 is a perspective view of the back of FIG. 5.
Figure 7A:
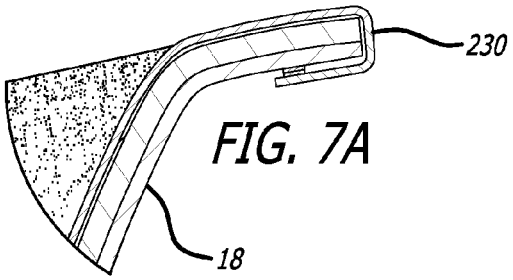
FIG. 7 is a side cross-sectional view of the back of FIG. 5.
Figure 7:
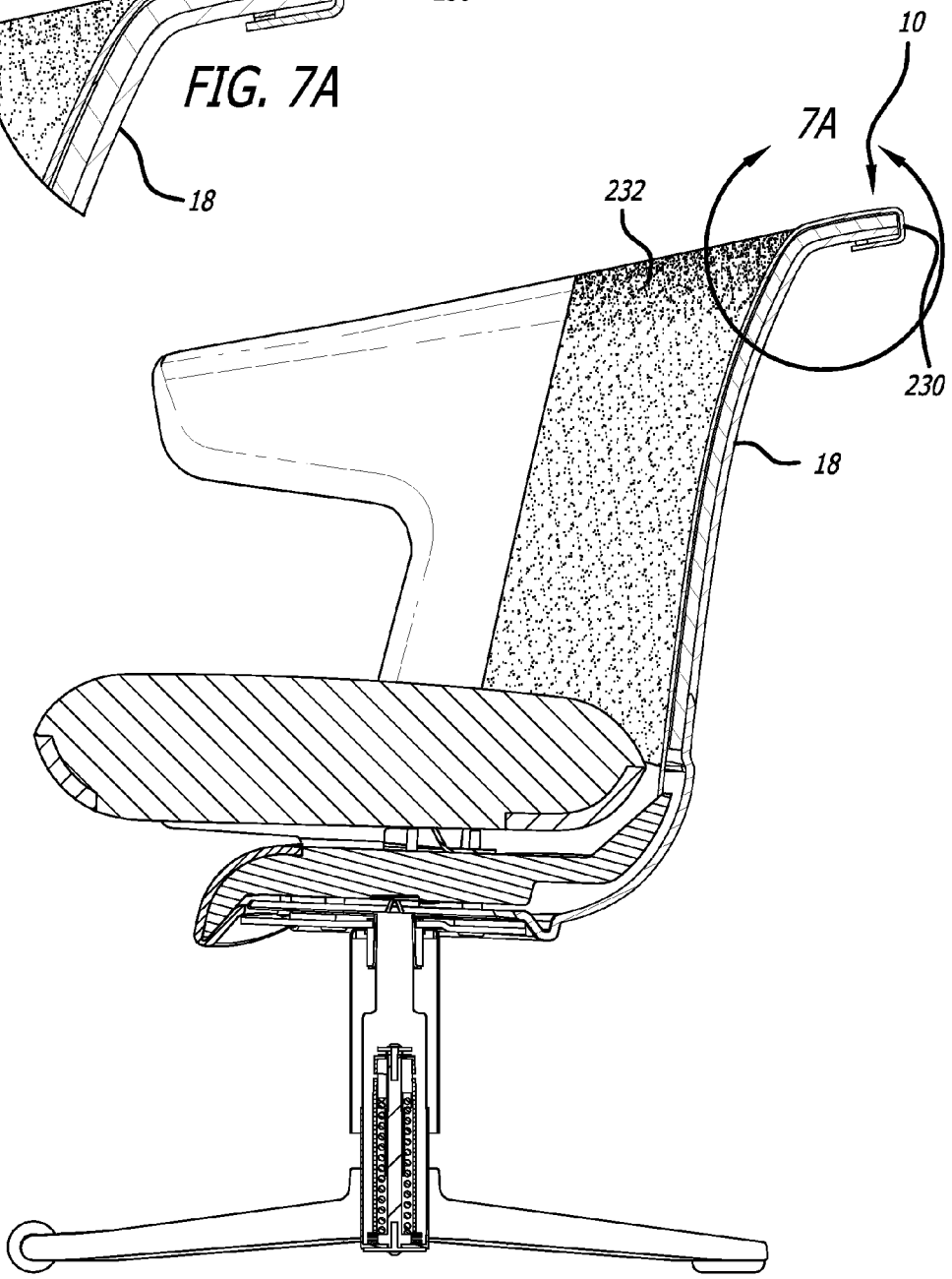
Figure 8:
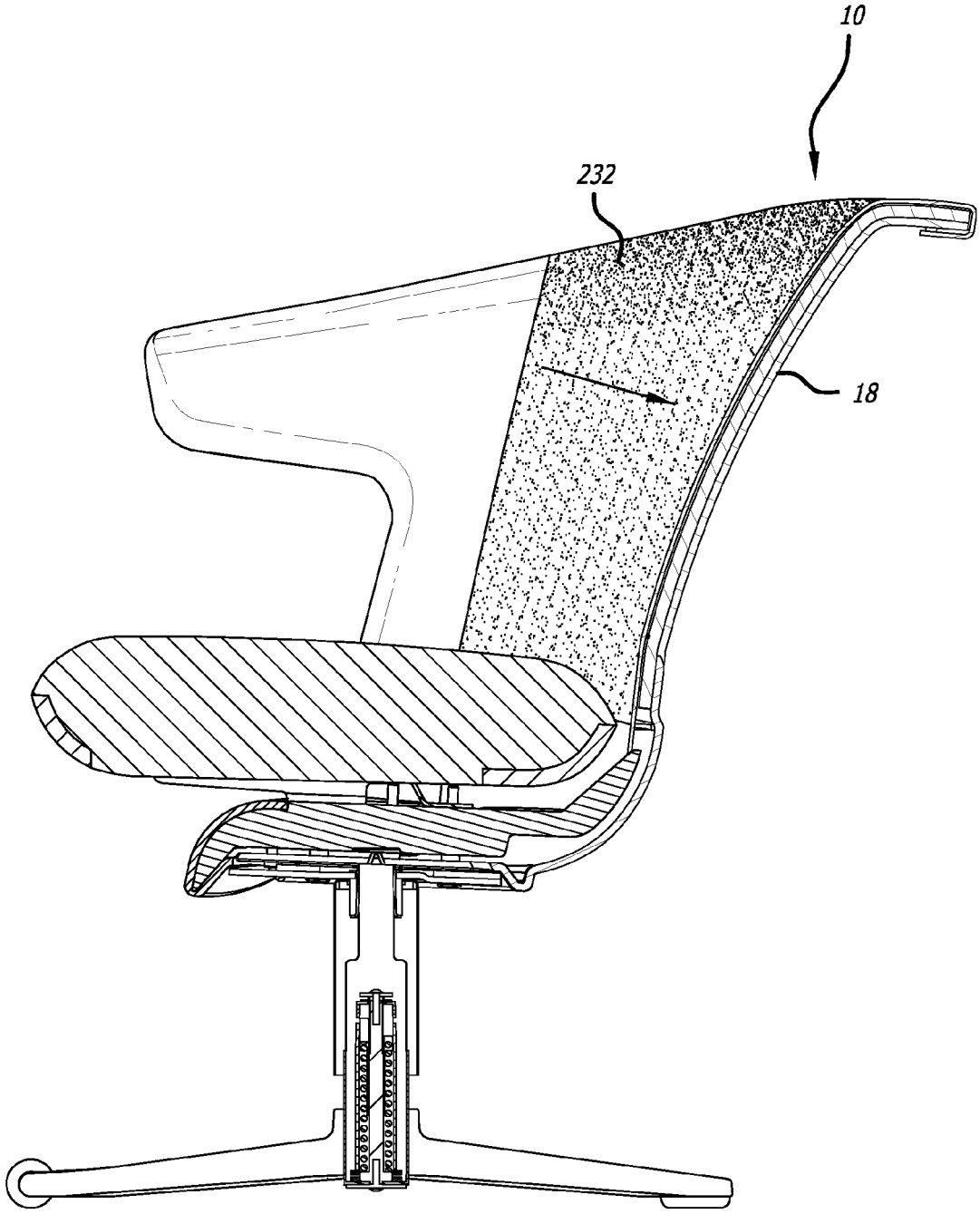
FIG. 8 shows the back of FIG. 7 when a load is applied.
Figure 10:
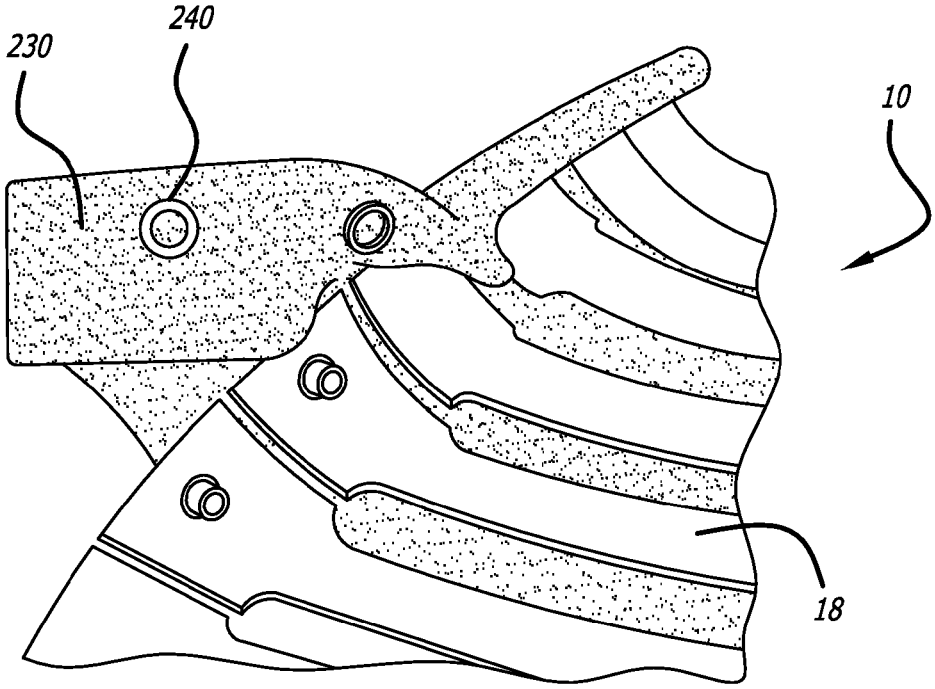
FIG. 10 shows the retainer being snapped onto the back of FIG. 5.

In one embodiment, shown in FIGS. 5-6, the retainer 230 may be a stretchable fabric bungee, elastomeric material or other semi-stretchable material coupled to the distal ends of the flexible finger elements 18. The retainer 230 is mechanically connected to the flexible finger elements 18, such as with snaps 240 as shown in FIG. 10. Other known attachment techniques could also be used. Alternatively, the retainer 230 could have pockets adapted to receive the ends of the flexible finger elements 18. The ends of the retainer 30 are secured to a structural frame of the seating unit 1.

In this embodiment, the retainer 230 has inherent characteristics such that the retainer 230 absorbs some of the load that may be applied to the flexible finger elements 18. As a load is applied to the flexible finger elements 18, they tend to spread apart. The retainer 230 limits the collective spreading of the flexible finger elements 18. According to this embodiment, the retainer 230 is preferably made from an elastic strap. However, it will be understood by those of skill in the art that the retainer 230 of this embodiment may be alternatively made from elastomeric material, bungee material, rubber, springs or any other suitable material. The elastic material of the retainer 230 preferably has two rates of flex recovery. The first limits the spread of the flexible finger elements 18. The second limits ultimate travel of the flexible finger elements 18 and ensures stability of the flexible finger elements 18 under heavy loads. Alternatively, two materials could be used cooperatively to form a retainer 230 with the desired flex characteristics. For example, two retainers 230 may be used, wherein one is flexible and one is inflexible. The first flexible retainer transfers load to adjacent flexible finger elements 18, and the second inflexible retainer limits ultimate travel of the flexible finger elements 18 when the slack is taken up. As a user sits in the chair and applies a load to the flexible finger elements 18, the elasticity of the fingers permits the fingers to spread allowing the back to conform to the user in the area proximate where the user is contacting the back 10. The barrel shape of the back 10 allows the user to sit in a variety of alternative postures. Further both the back 10 and the seat 16 can rotate. A user may wish to sit with is back to toward one or the other of the armrests rather than the center of the back. The back 10 could be rotated so that the armrest is in front of the user with the side of the user contacting the back 10. The side of a user has a different contour and different comfort needs than a user's back.

In another embodiment, the retainer 230 may be constructed of a relatively inflexible material such as cable or chain. The flexible finger elements 18 would still be able to flex a certain distance; however, when the flexible finger elements 18 flexed a distance such that slack in the cable or chain is taken up, further flex of the flexible finger elements 18 would be constrained by the retainer 230.

While the retainers 30, 230 shown is FIGS. 1-2 and 5-6 are single continuous retainers, it is also contemplated that the retainer may be segmented such that several retainers are employed. If separate retainers are used, they may have varying rates of elastic return to proscribe motion differently in different areas of the back 10.

Figure 9:
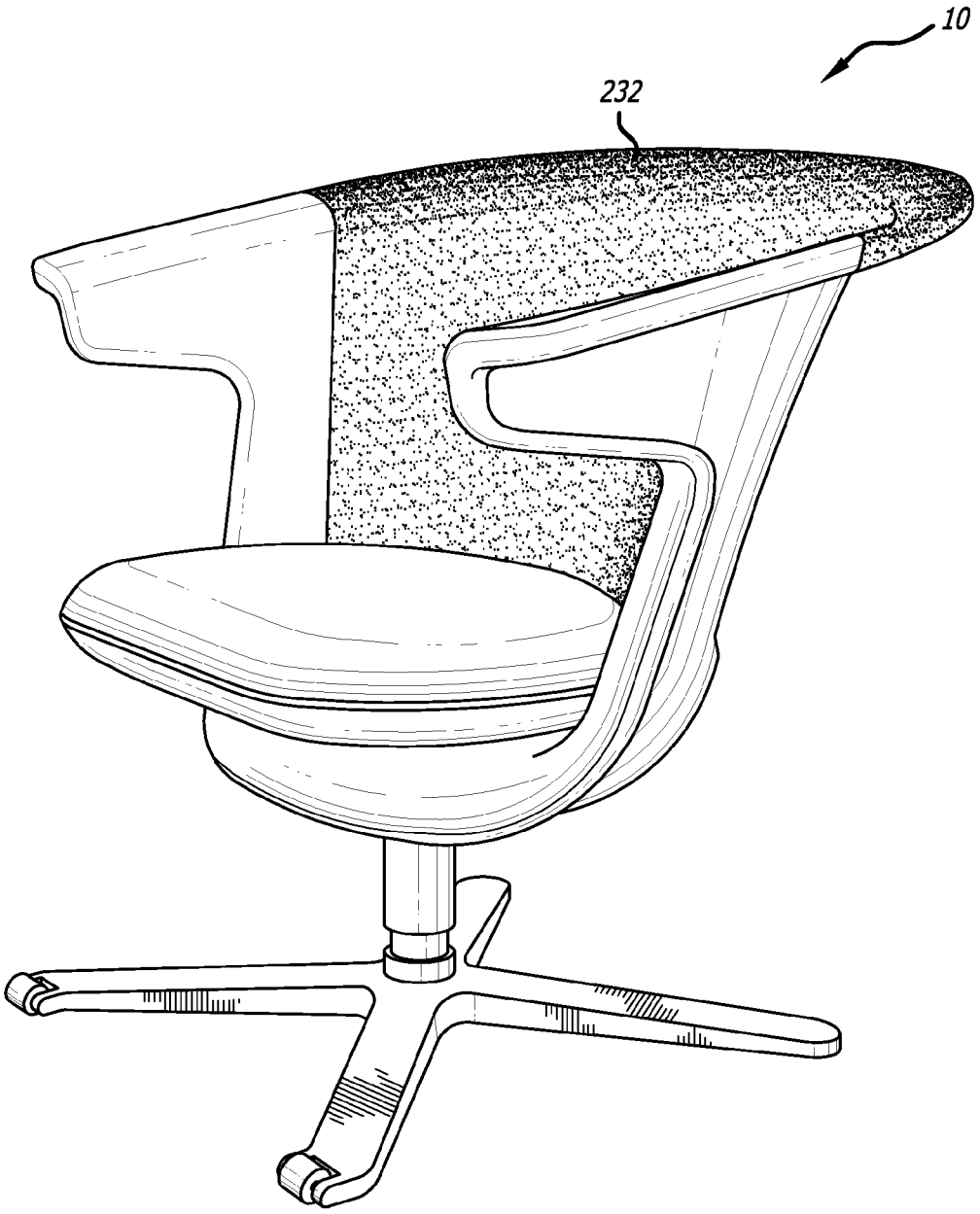
FIG. 9 is a front perspective view of the back of FIG. 5 with fabric attached.

As shown in FIG. 9, the seating unit may be upholstered. The flexible finger elements 18 could be exposed and visible as in FIGS. 5-6, or the fingers could be hidden by a fabric 232 and have the visual of a fully upholstered seating unit. The fabric 232 may cover at least a portion of the plurality of flexible finger elements 18. According to the present invention, the fabric 232 is sufficiently flexible such that it does not significantly hinder the flexibility of the flexible finger elements 18. Further, the fabric 232 will work in conjunction with the retainer 230 to both distribute the load applied between the flexible finger elements 18 and limit the collective spreading of the flexible finger elements 18. The flexible finger elements 18, retainer 230 and fabric 232 work as a unit to distribute loads.

The fabric 232 may be attached to a ring or spline element which is secured in a channel in the back 10. When a load is applied to the back 10, a portion of the load is transferred to fabric 232 which goes into tension limiting the distance the flexible finger elements 18 may travel.

The fabric 232 may also be attached to the retainer 230 as show in FIG. 6. The fabric 232 is also upholstered to the frame and is attached under the seat 16 with a flexible webbing. When a load is applied to the flexible finger elements 18, the fabric 232 may be pulled vertically and/or horizontally. The limit of flexibility of the fabric 232 limits and controls the movement of the flexible finger elements 18. Thus, the flexible finger elements 18, the retainer 230 and the fabric 232 work as a unit to absorb load. When the fabric 232 stretches in the horizontal direction, the fabric 232 is "shortened" in the vertical direction. Including a flexible webbing or skirt at the bottom of the back 10, prevents the fabric 232 from puddling or from stretching and holding an undesired set.

The present invention has been described above with reference to exemplary embodiments. However, those skilled in the art having read this disclosure will recognize that changes and modifications may be made to the exemplary embodiments without departing from the scope of the present invention.

What is claimed is:

1. A seating unit comprising:

a seat;

a first arm and a second arm, the first and second arms being coupled to the seat;

a flexible back coupled to the seat, the first arm and the second arm, the flexible back defining a discrete plurality of flexible zones disposed between the first arm and the second arm, wherein the flexible back is not integrally formed with either the first arm and the second arm, and wherein the flexibility of the flexible zones of the flexible back is independent of the first and second arms, the flexible back comprising:

a plurality of flexible finger elements having distal ends, each of the plurality of flexible finger elements being formed of an elastomeric material and adapted to be flexible independently of the other flexible finger elements, the plurality of flexible finger elements cooperatively defining a lumbar region and a thoracic region, wherein a first flexible zone defines at least a portion of the lumbar region of the back and a second flexible zone defines a portion of the back extending from the lumbar region through at least a portion of the thoracic region of the back, and wherein the first flexible zone has a first flexibility and the second flexible zone has a second flexibility, the second flexibility being greater than the first flexibility;

a flexible retainer defining an uppermost and continuous edge of the flexible back, the flexible retainer being disposed in a generally coextensive relationship with an upper portion of the first and second arms and connecting at least two of the flexible finger elements proximate their distal ends, the flexible retainer having a third flexibility, the third flexibility being greater than the second flexibility, wherein when a load is applied to at least one flexible finger element, the flexible retainer distributes at least a portion of the load to at least one adjacent flexible finger element, wherein the plurality of flexible finger elements and the flexible retainer adapt to the shape of a user; and wherein the elastomeric material of which the flexible finger elements are formed has a first durometer and the retainer is comprised of a material having a second durometer, the second durometer being a lower durometer than the first durometer.

2. A seating unit comprising:

a seat;

a first arm and a second arm, the first and second arms being coupled to the seat;

a flexible back coupled to the seat, the first arm and the second arm, the flexible back defining a discrete plurality of flexible zones disposed between the first arm and the second arm, wherein the flexible back is not integrally formed with either the first arm and the second arms, wherein the flexibility of the flexible zones of the flexible back is independent of the first and second arms, and wherein when the flexible back is attached to a seat, a first arm and a second arm, the flexible retainer is disposed in a generally coextensive relationship with an upper portion of the first and second arms:

a plurality of flexible finger elements having distal ends, each of the plurality of flexible finger elements being formed of an elastomeric material and adapted to be flexible independently of the other flexible finger elements, the plurality of flexible finger elements cooperatively defining a lumbar region and a thoracic region, wherein a first flexible zone defines at least a portion of the lumbar region of the back and a second flexible zone defines a portion of the back extending from the lumbar region through at least a portion of the thoracic region of the back, and wherein the first flexible zone has a first flexibility and the second flexible zone has a second flexibility, the second flexibility being greater than the first flexibility;

a flexible retainer defining an uppermost and continuous edge of the flexible back, the flexible retainer connecting at least two of the flexible finger elements proximate their distal ends, the flexible retainer having a third flexibility, the third flexibility being greater than the second flexibility, wherein when a load is applied to at least one flexible finger element, the flexible retainer distributes at least a portion of the load to at least one adjacent flexible finger element, wherein the plurality of flexible finger elements and the flexible retainer adapt to the shape of a user; and wherein the elastomeric material of which the flexible finger elements are formed has a first durometer and the retainer is comprised of a material having a second durometer, the second durometer being a lower durometer than the first durometer.

* * * * *

UNITED STATES PATENT AND TRADEMARK OFFICE

CERTIFICATE OF CORRECTION

PATENT NO. : 8,876,209 B2
APPLICATION NO. : 12/454995
DATED : November 4, 2014
INVENTOR(S) : Peterson et al.

It is certified that error appears in the above-identified patent and that said Letters Patent is hereby corrected as shown below:

Specification

Column 1, line 12: replace “to back” with -- to a back --

Column 1, line 63: replace the second instance of “the” with -- they --

Column 2, lines 43-44: replace “for seating” with -- for a seating --

Column 4, line 24: replace “applies” with -- applied --

Column 5, lines 61-62: delete “of”

Column 6, line 59: replace “is” with -- his --

Column 6, line 60: delete “to”

Column 7, line 5: replace “is” with -- in --

Claims

Column 8, claim 2, line 37: replace “arm” with -- arms --

Column 8, claim 2, line 42: replace “:” with -- ; --

Signed and Sealed this
Eighteenth Day of August, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,876,209 B2
APPLICATION NO. : 12/454995
DATED : November 4, 2014
INVENTOR(S) : Peterson et al.

It is certified that error appears in the above-identified patent and that said Letters Patent is hereby corrected as shown below:

In the Claims

Column 8, Claim 2, Line 35 - Line 36: replace "...formed with either the first arm and the second arms, wherein the flexibility of the flexible zones of the..." with --...formed with either of the first arm and the second arm, wherein the flexibility of the flexible zones of the...--

Signed and Sealed this
Thirteenth Day of February, 2018

Andrei Iancu

Andrei Iancu
*Director of the United States Patent and Trademark Office*